US006433311B1

(12) United States Patent
Teramura et al.

(10) Patent No.: US 6,433,311 B1
(45) Date of Patent: Aug. 13, 2002

(54) GLOW PLUG

(75) Inventors: Hideki Teramura, Mie; Hiroyuki Kimata, Aichi, both of (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 10/004,841

(22) Filed: Dec. 7, 2001

(30) Foreign Application Priority Data

Dec. 22, 2000 (JP) ..... 2000-391671

(51) Int. Cl.[7] ..... F23Q 7/22
(52) U.S. Cl. ..... 219/270
(58) Field of Search ..... 219/270, 544, 219/541; 123/145 A, 145 R; 361/264–266

(56) References Cited

U.S. PATENT DOCUMENTS 6,064,039 A * 5/2000 Kumada ..... 219/270

FOREIGN PATENT DOCUMENTS

| | | | | |
|---|---|---|---|---|
| JP | 58-150258 | | 9/1983 | |
| JP | 61-8526 | * | 1/1986 | ..... 219/270 |
| JP | 62-22911 | * | 1/1987 | ..... 219/270 |
| JP | 62-59314 | | 3/1987 | |
| JP | 63-297922 | | 12/1988 | |
| JP | 3-10844 | | 2/1991 | |
| JP | 5-18536 | | 1/1993 | |
| JP | 6-331145 | | 11/1994 | |
| JP | 7-42939 | | 2/1995 | |
| JP | 11-2406 | | 1/1999 | |

* cited by examiner

*Primary Examiner*—John A. Jeffery
(74) *Attorney, Agent, or Firm*—Sughrue Mion, PLLC

(57) ABSTRACT

A glow plug includes an inner pole and a ceramic heating rod disposed in and fixed to an outer shell at uppermost and lowermost pole fixed portions A, C and a heating rod fixed portion D. A ratio of L2/L1 is larger than 2, where L1 is a distance from the lower end of the inner pole to the lower end of the fixed portion C; and L2 is a distance from the lower end of the inner pole to the lower end of the fixed portion A. A ratio of L3/L4 is smaller than 15, wherein L3 is a distance from a middle point between the lower end of the inner pole and the upper end of the heating rod to the lower end of the fixed portion C; and L4 is a distance from the above middle point to the upper end of the fixed portion D.

14 Claims, 1 Drawing Sheet

The Figure
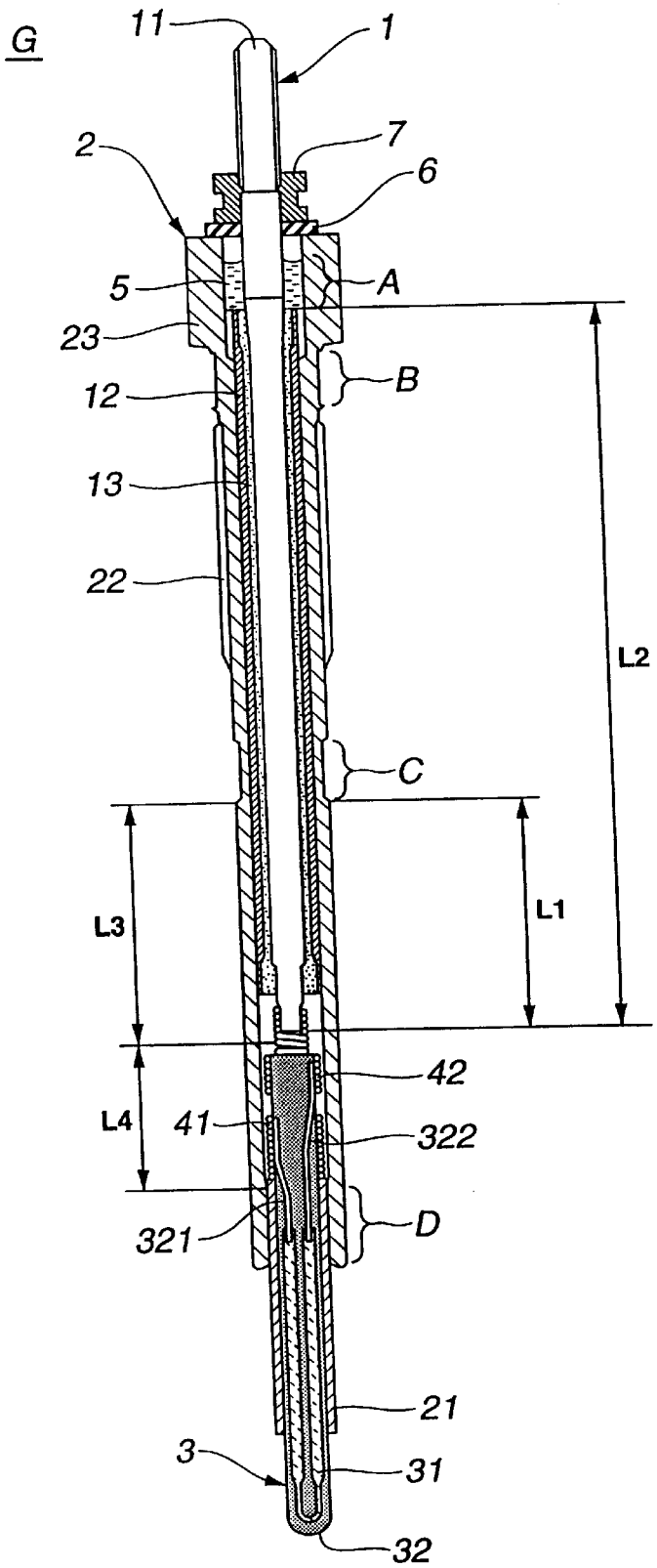

GLOW PLUG

BACKGROUND OF THE INVENTION

The present invention relates to a glow plug, and more specifically a glow plug that is highly resistant to shocks and vibrations even when it is longer than conventional. The present invention further relates to a glow plug suitable for a direct injection diesel engine.

For pollution control, a direct injection diesel engine has recently come into use. In some cases, the direct injection diesel engine requires a glow plug longer than conventional.

SUMMARY OF THE INVENTION

The glow plug is inevitably subjected to shocks and vibrations transmitted thereto from the engine over a long period of usage, and at the same time, is caused to resonate by the shocks and vibrations. Accordingly, in such a longer glow plug, it is highly likely that a ceramic member is cracked and/or an electric conductor that connects a ceramic heater with an inner pole is broken under the influence of the shocks, vibrations and resonance.

It is therefore an object of the present invention to provide a glow plug that attains excellent durability over a longer period of usage, when it has a length similar to a conventional glow plug.

It is also an object of the present invention to provide a glow plug that is highly resistant to shocks and vibrations, even when it has a greater length than a conventional glow plug.

According to one aspect of the invention, there is provided a glow plug comprising: an outer shell; an inner pole disposed partly in the outer shell and fixed thereto at a plurality of pole fixed portions, the inner pole having first and second ends, the pole fixed portions including first and second pole fixed portions located nearest to the first and second ends of the inner pole, respectively, each of the first and second pole fixed portions having first and second ends located nearer to the first and second ends of the inner pole, respectively; a ceramic heating rod disposed partly in the outer shell in line with the inner pole, the ceramic heating rod having first and second ends, the second end of the ceramic heating rod being located adjacent to the first end of the inner pole; and an electric conductor electrically connecting the inner pole with the ceramic heating rod, wherein a ratio of L2/L1 is larger than 2, where L1 is a distance from the first end of the inner pole to first end of the first pole fixed portion and L2 is a distance from the first end of the inner pole to the first end of the second pole fixed portion.

According to another aspect of the invention, there is provided a glow plug comprising: an outer shell; an inner pole disposed partly in the outer shell and fixed thereto at one or more pole fixed portions, the inner pole having first and second ends, the one or more pole fixed portions including a first pole fixed portion located nearest to the first end of the inner pole, the first pole fixed portion having first and second ends located nearer to the first and second ends of the inner pole, respectively; a ceramic heating rod partly disposed in the outer shell in line with the inner pole and fixed thereto at one or more heating rod fixed portions, the ceramic heating rod having first end and second ends, the second end of the ceramic heating rod being located adjacent to the first end of the inner pole, the one or more heating rod fixed portions including a first heating rod fixed portion located nearest to the second end of the ceramic heating rod, the first heating rod fixed portion having first and second ends located nearer to the first and second ends of the ceramic heating rod, respectively; and an electric conductor electrically connecting the inner pole with the ceramic heating rod, wherein a ratio of L3/L4 is smaller than 15, where L3 is a distance from a middle point between the first end of the inner pole and the second end of the ceramic heating rod to the first end of the first pole fixed portion and L4 is a distance from the middle point to the second end of the first heating rod fixed portion.

BRIEF DESCRIPTION OF THE DRAWING

The FIGURE is a sectional view of a glow plug G according to a preferred embodiment of the invention.

DESCRIPTION OF THE PREFERRED EMBODIMENT

A glow plug G according to one embodiment of the invention will be explained below with reference to FIG. 1. Herein, the terms "upper" and "lower" are used to indicate positions when the glow plug G is observed in the orientation of the FIGURE.

As shown in the FIGURE, the glow plug G includes a metallic outer shell 2, an inner pole 1, a ceramic heating rod 3 and coiled electric conductors 41, 42.

The outer shell 2 is formed into a cylindrical shape so that the inner pole 1 and the ceramic heating rod 3 are disposed partly within the outer shell 2 and in line with each other. Although the outer shell 2 is formed of a single piece in the present embodiment as shown in FIG. 1, it can be formed of some separate sections (including, e.g., a section for covering the inner pole 1 and a section for covering the ceramic heating rod 3).

A threaded portion 22 is formed on the outer shell 2, and is adapted to attach the glow plug G to a cylinder head (not shown in the drawing). A tool engaging portion 23 is also formed on the outer shell 2 to be engaged with a tool (not shown) for fitting the glow plug G in the cylinder head.

The inner pole 1 has a terminal rod 11 made of, e.g., low carbon steel and a metallic inner shell 12 made of, e.g., SUS304 (stainless steel according to JIS). The terminal rod 11 is coaxially retained in the inner shell 12. A space between the terminal rod 11 and the inner shell 12 is filled with a filling material 13 of, e.g., magnesia powder. At the time of filling with the filling material 13, one end of the inner shell 12 is closed up with a rubber plug (not shown). Then, the filling material 13 is compressed by swaging the inner shell 12 from its outside to inside, before the rubber plug is removed. It is therefore possible to attain a high mechanical strength of the terminal rod 11. It is also possible to assemble the inner pole 1 easily, being electrically insulated from the outer shell 2.

The ceramic heating rod 3 includes a heating resistor 31, lead wires 321, 322 and a ceramic body 32. The heating resistor 31 and the lead wires 321, 322 are disposed in the ceramic body 32, as shown in the FIGURE. The heating resistor 31 is formed into a U-like shape. One end portion of each lead wire 321, 322 is connected to the heating resistor 31, while the other end portion is exposed at the surface of the ceramic body 32. The ceramic heating rod 3 further includes a protective shell 21 that covers the ceramic body 32. The protective shell 21 is brazed to the ceramic body 32 by filling a space between the ceramic body 32 and the protective shell 21 with a brazing filler, while heated. The ceramic body 32 protrudes from the lower end of the protective shell 21 by some distance (e.g., by a distance of 9 mm), upon shrinkage of the protective shell 21 and the brazing filler, when cooled.

The electric conductor 41 is fit onto the ceramic body 32, and is brazed so as to establish an electrical connection between the lead wire 321 and the protective shell 21 through the electric conductor 41. One end portion of the electric conductor 42 is fit on and brazed to the ceramic body 32, while the other end portion is fit on and welded to the inner pole 1, thereby establishing an electrical connection between the lead wire 322 and the inner pole 1 through the electric conductor 42.

The inner pole 1 and the ceramic heating rod 3, attached to each other as described above, are disposed in and fixed to the outer shell 2 at a plurality of fixed portions. As used herein, the term "fix" is intended to mean to prevent movement of the inner pole 1 and the ceramic heating rod 3 relative to the outer shell 2. The number of the fixed portions is not specifically limited. The length of each fixed portion is not limited either.

The fixing of the inner pole 1 and the ceramic heating rod 3 to the outer shell 2 can be carried out according to any conceivable method. In other words, the inner pole 1 and the ceramic heating rod 3 may be directly fixed to the outer shell 2 by, e.g., caulking. Alternatively, the inner pole 1 and the ceramic heating rod 3 may be fixed to the outer shell 2 by, e.g., press fitting, shrinkage fitting or swaging with a fixing material, such as an insulation ring, a glass sealing material, a heat resisting resin and a powder filler.

For example, the inner pole 1 and the ceramic heating rod 3 can be fixed to the outer shell 2 at four fixed portions A to D, as shown in the FIGURE. At the fixed portion D, an upper end portion of the protective tube 21 may be brazed to a lower end portion of the outer shell 2. The protective shell 21 thus gets in the outer shell 2 by some distance (e.g., by a distance of 8 mm). The outer shell 2 may be caulked at each of the fixed portions B and C. A sealing material 5 of, e.g., glass powder may be packed in a space between the inner pole 1 and the outer shell 2, and then, dissolved and solidified at the fixed portion A.

A nut 7 is screwed onto the inner pole 1, while an insulating member 6 is interposed between the inner pole 1 and the nut 7.

Accordingly, when a voltage is applied to the glow plug G, the voltage is supplied to the heating resistor 31 through the inner pole 1, the electric conductor 42 and the lead wire 322. Also, the heating resistor 31 is grounded through the lead wire 321, the electric conductor 41, the protective shell 21 and the outer shell 2 to an engine block (not shown in the drawing). The heating resistor 31 thus generates heat through electrical resistance.

Herein, for explanation purposes, distances L1 to L4 are defined as follows.

L1: A distance from the lower end of the inner pole 1 to the lower end of the lowermost fixed portion at which the inner pole 1 is fixed to the outer shell 2 (e.g., the fixed portion C in the FIGURE).

L2: A distance from the lower end of the inner pole 1 to the lower end of the uppermost fixed portion at which the inner pole 1 is fixed to the outer shell 2 (e.g., the fixed portion A in the FIGURE).

L3: A distance from the middle point between the lower end of the inner pole 1 and the upper end of the ceramic heating rod 3 to the lower end of the lowermost fixed portion at which the inner pole 1 is fixed to the outer shell 2 (e.g., the fixed portion C in the FIGURE).

L4: A distance from the middle point between the lower end of the inner pole 1 and the upper end of the ceramic heating rod 3 to the upper end of the uppermost fixed portion at which the ceramic heating rod 3 is fixed to the outer shell 2 (e.g., the fixed portion D in the FIGURE).

According to the invention, the inner pole 1 and the ceramic heating rod 3 are fixed to the outer shell 2 so that a ratio of L2/L1 is adjusted to be larger than 2; preferably equal to or larger than 2.5, and/or so that a ratio of L3/L4 is adjusted to be smaller than 15; preferably equal to or smaller than 10; more preferably within a range from 1 to 6; and still more preferably within a range from 1 to 4. When the ratio of L2/L1 is equal to or smaller than 2, the glow plug G cannot attain sufficiently high shock and vibration resistance. The glow plug G cannot attain sufficiently high shock and vibration resistance either, when the ratio of L3/L4 is equal to or larger than 15. The glow plug G can attain especially high shock and vibration resistance, when the inner pole 1 and the ceramic heating rod 3 are fixed to the outer shell 2 in both of the above-described ratios of L2/L1, L3/L4.

Further, it is especially advantageous that the inner pole 1 and the ceramic heating rod 3 are fixed to the outer shell 2 in at least one of the above-described ratios of L2/L1, L3/L4 in order to attain high shock and vibration resistance of the glow plug G, when the glow plug G has a length of not less than 8 cm (normally not greater than 20 cm); particularly not less than 10 cm; and more particularly not less than 15 cm, from the upper end of the inner pole 1 to the lower end of the ceramic heating rod 3.

In the case where the glow plug G is installed on an internal combustion engine, such as a direct injection diesel engine, the glow plug G is subjected to vibrations transmitted thereto from the engine in operation. Resonance occurs, if the glow plug G has a resonance frequency similar to the frequency of such vibrations (normally 20 to 1000 Hz). However, the glow plug G can gain a resonance frequency of not less than 2000 Hz (normally not greater than 5000 Hz); and preferably not less than 2500 Hz, at the lower end portion of the inner pole 1, when the inner pole 1 and the ceramic heating rod 3 are fixed to the outer shell 2 in the above-described ratios of L2/L1, L3/L4. It is therefore possible to highly improve the vibration resistance of the glow plug G by avoiding such resonance.

The invention will be specifically illustrated in more detail by way of the following experiments.

EXPERIMENT 1

A variety of glow plugs G1 to G12 were manufactured according to the above-described embodiment with different ratios of L2/L1, L3/L4 as listed in TABLE 1. In each glow plug, the inner pole 1 and the ceramic heating rod 3 were fixed to the outer shell 2 by brazing at the fixed portion D, by caulking over 5 mm at each of the fixed portions B and C, and then, by glass sealing at the fixed portion A, as shown in the FIGURE. The ceramic body 32 protruded from the lower end of the protective shell 21 by 9 mm, while the protective shell 21 got in the outer shell 21 by 8 mm. The terminal rod 11 was made of low carbon steel, the inner shell 12 was made of SUS304, and the filling material 13 was of magnesia powder.

Then, the glow plugs G1 to G12 were tested for their shock and vibration resistance, respectively.

According to the vibration testing method for automobile parts of JIS D 1601 (1995) as indicated at JIS D 5103 (1992), vibration tests were conducted with a vibration number of $1.0\times10^7$, a frequency of 20 to 2000 Hz and an acceleration of 25 G.

The test results are indicated in TABLE 1. Herein, five samples were used for each glow plug for determining its vibration resistance. The vibration resistance was marked "A", when all of the samples (i.e., five samples) were energized to the end. The vibration resistance was marked "B", when four samples were energized to the end, but one sample ended up unable to be energized in process of the test. When all of the samples became unable to be energized in midstream, the vibration resistance was marked "C".

According to the method of JIS B 8031 (1995) (although it is intended for spark plugs for internal combustion engines), shock tests were conducted with a stroke of 5 mm and a test time of 10 minutes. The test results are indicated in TABLE 1. The shock resistance was determined in the same manner as the vibration resistance.

As apparent from TABLE 1, the glow plugs G4 to G6 attained high shock and vibration resistance with the respective ratios of L2/L1 larger than 2 (particularly equal to or larger than 2.5). Similarly, the glow plugs G7 to G10 attained high shock and vibration resistance with the respective ratios of L3/L4 smaller than 15 (particularly equal to or smaller than 10). Each of the glow plugs G4 to G7 consistently attained excellent shock and vibration resistance, when the ratio of L2/L1 was larger than 2, and at the same time, the ratio of L3/L4 was smaller than 15.

EXPERIMENT 2

A glow plug G13 was further manufactured in the same manner as the glow plug G4, except that the inner pole 1 was not fixed to the outer shell 2 at the fixed portion C. That is, the ratios of L2/L1, L3/L4 were 2.5 and 2, respectively in the glow plug G4. On the other hand, the ratios of L2/L1, L3/L4 are not greater than 2 and not smaller than 15, respectively, in the glow plug G13.

The resonance frequencies of the glow plugs G4 and G13 were measured at the respective lower end portions of the inner poles 1 as below.

In each glow plug, a hole of 3 mm in diameter was formed in the lower end portion of the inner pole 1. Then, each glow plug was screwed into and fixed to the equivalent of a cylinder head. The resonance frequency was measured from the hole, while giving an impact by a blow to the equivalent.

The glow plug G4 had a resonance frequency of 2500 Hz, whereas the glow plug G13 had a resonance frequency of 1000 Hz. In other words, the resonance frequency of the glow plug G4 was much higher than the frequency (normally of 20 to 1000 Hz) of vibrations transmitted from an internal combustion engine, such as a direct injection diesel engine. It is therefore considered that resonance would be hardly able to occur to the glow plug G4 even where the glow plug G4 is installed on the internal combustion engine.

As described above, a glow plug according to the invention is highly resistant to shocks and vibrations. Particularly, a glow plug according to the invention can attain high shock and vibration resistance, even when it has a greater length than a conventional glow plug. Thus, the glow plug of the invention may be suitably used in a direct injection diesel engine.

Although the invention has been described with reference to a specific embodiment of the invention, the invention is not limited to the above-described embodiment. Modification and variation of the embodiment described above will occur to those skilled in the art in light of the above teaching. For example, the inner pole 1 may be comprised of the terminal rod 11 only, without the inner shell 12 and the filling material 13. The electric conductors 41, 42 may be of another type i.e., of rod type. The scope of the invention is defined with reference to the following claims.

TABLE 1

| Glow Plug | | L2/L1 | L3/L4 | Vibration Resistance | Shock Resistance |
|---|---|---|---|---|---|
| Comparative Example | G1 | 1 | 2 | C | C |
| | G2 | 1.5 | | B | C |
| | G3 | 2 | | A | B |
| Invention | G4 | 2.5 | | A | A |
| | G5 | 3 | | A | A |
| | G6 | 3.5 | | A | A |
| | G7 | 2.5 | 0.5 | A | A |
| | G8 | | 1 | A | A |
| | G9 | | 5 | A | A |
| | G10 | | 10 | A | A |
| Comparative Example | G11 | | 15 | B | A |
| | G12 | | 20 | C | B |

What is claimed is:

1. A glow plug comprising:

an outer shell;

an inner pole disposed partly in the outer shell and fixed thereto at a plurality of pole fixed portions, the inner pole having first and second ends, the pole fixed portions including first and second pole fixed portions located nearest to the first and second ends of the inner pole, respectively, each of the first and second pole fixed portions having first and second ends located nearer to the first and second ends of the inner pole, respectively;

a ceramic heating rod disposed partly in the outer shell in line with the inner pole, the ceramic heating rod having first and second ends, the second end of the ceramic heating rod being located adjacent to the first end of the inner pole; and an electric conductor electrically connecting the inner pole with the ceramic heating rod, wherein a ratio of L2/L1 is larger than 2, where L1 is a distance from the first end of the inner pole to first end of the first pole fixed portion and L2 is a distance from the first end of the inner pole to the first end of the second pole fixed portion.

2. The glow plug according to claim 1, wherein the ratio of L2/L1 is equal to or larger than 2.5.

3. The glow plug according to claim 1, having a length of equal to or greater than 8 cm from the second end of the inner pole to the first end of the ceramic heating rod.

4. The glow plug according to claim 3, having a length of equal to or greater than 10 cm from the second end of the inner pole to the first end of the ceramic heating rod.

5. The glow plug according to claim 4, having a length of equal to or greater than 15 cm from the second end of the inner pole to the first end of the ceramic heating rod.

6. A glow plug comprising:

an outer shell;

an inner pole disposed partly in the outer shell and fixed thereto at one or more pole fixed portions, the inner pole having first and second ends, the one or more pole fixed portions including a first pole fixed portion located nearest to the first end of the inner pole, the first pole fixed portion having first and second ends located nearer to the first and second ends of the inner pole, respectively;

a ceramic heating rod disposed partly in the outer shell in line with the inner pole and fixed thereto at one or more heating rod fixed portions, the ceramic heating rod having first and second ends, the second end of the ceramic heating rod being located adjacent to the first end of the inner pole, the one or more heating rod fixed portions including a first heating rod fixed portion located nearest to the second end of the ceramic heating rod, the first heating rod fixed portion having first and second ends located nearer to the first and second ends of the ceramic heating rod, respectively; and an electric conductor electrically connecting the inner pole with the ceramic heating rod, wherein a ratio of L3/L4 is smaller than 15, where L3 is a distance from a middle point between the first end of the inner pole and the second end of the ceramic heating rod to the first end of the first pole fixed portion and L4 is a distance from the middle point to the second end of the first heating rod fixed portion.

7. The glow plug according to claim 6, wherein the one or more pole fixed portions further includes a second pole fixed portion located nearest to the second end of the inner pole, the second pole fixed portion having first and second ends located nearer to the first and second ends of the inner pole, respectively, and a ratio of L2/L1 is larger than 2, where L1 is a distance from the first end of the inner pole to the first end of the first pole fixed portion and L2 is a distance from the first end of the inner pole to the first end of the second pole fixed portion.

8. The glow plug according to claim 6, wherein the ratio of L3/L4 is equal to or smaller than 10.

9. The glow plug according to claim 8, wherein the ratio of L3/L4 is within a range from 1 to 6.

10. The glow plug according to claim 9, where in the ratio of L3/L4 is within a range from 4 to 6.

11. The glow plug according to claim 7, wherein the ratio of L2/L1 is equal to or larger than 2.5.

12. The glow plug according to claim 6, having a length of equal to or greater than 8 cm from the second end of the inner pole and the first end of the ceramic heating rod.

13. The glow plug according to claim 12, having a length of equal to or greater than 10 cm from the second end of the inner pole and the first end of the ceramic heating rod.

14. The glow plug according to claim 13, having a length of equal to or greater than 15 cm from the second end of the inner pole and the first end of the ceramic heating rod.

* * * * *